US007040132B2

(12) United States Patent
Lonero

(10) Patent No.: US 7,040,132 B2
(45) Date of Patent: May 9, 2006

(54) TWO-PIECE UPPER TOOL

(75) Inventor: Vincent J. Lonero, Troy, MI (US)

(73) Assignee: Lonero Engineering Company, Inc., Troy, MI (US)

( * ) Notice: Subject to any disclaimer, the term of this patent is extended or adjusted under 35 U.S.C. 154(b) by 42 days.

(21) Appl. No.: 10/821,682

(22) Filed: Apr. 9, 2004

(65) Prior Publication Data

US 2004/0206146 A1 Oct. 21, 2004

Related U.S. Application Data

(60) Provisional application No. 60/463,960, filed on Apr. 18, 2003, provisional application No. 60/466,591, filed on Apr. 30, 2003.

(51) Int. Cl.
*B21D 15/00* (2006.01)

(52) U.S. Cl. ..... 72/110; 72/237

(58) Field of Classification Search ..... 72/107, 72/110, 237, 238, 239, 473, 478; 29/6.01; 384/51, 58, 621, 622, 623
See application file for complete search history.

(56) References Cited

U.S. PATENT DOCUMENTS

| | | | | |
|---|---|---|---|---|
| 2,704,950 | A * | 3/1955 | Scott | 72/104 |
| 4,785,649 | A * | 11/1988 | Watanabe et al. | 72/104 |
| 5,699,692 | A | 12/1997 | Lonero et al. | |
| 5,806,184 | A | 9/1998 | Lonero et al. | |
| 6,159,135 | A | 12/2000 | Lonero et al. | |
| 6,253,590 | B1 | 7/2001 | Lonero et al. | |
| 6,257,037 | B1 | 7/2001 | Lonero et al. | |
| 6,360,574 | B1 * | 3/2002 | Vodopyanov | 72/110 |
| 6,601,424 | B1 * | 8/2003 | Bagusche | 72/110 |
| 6,684,924 | B1 * | 2/2004 | Kelders et al. | 156/523 |

* cited by examiner

*Primary Examiner*—Ed Tolan
(74) *Attorney, Agent, or Firm*—Raggio & Dinnin, P.C.

(57) ABSTRACT

The two-piece upper work tool 20 includes a first body member 22 and a second body member 24 which are generally mirror images of each other. The body members 22, 24 include a plurality of orifices 28 therethrough. One of the body members 22 includes a plurality of elongated slots 26 with a circular shape at one end thereof. The other body member 24 has a plurality of fasteners, posts or dowels 30 extending from a surface thereof which interact and mate with the elongated slots 26 on the opposite body member 22. The body members 22, 24 include a rectangular shaped recess 32 on one end thereof and also include a plurality of pockets or cavities on inner surfaces thereof. One of the pockets includes a diameter for a back-up roller generally encompassing 360° except for a very small top portion thereof.

16 Claims, 5 Drawing Sheets

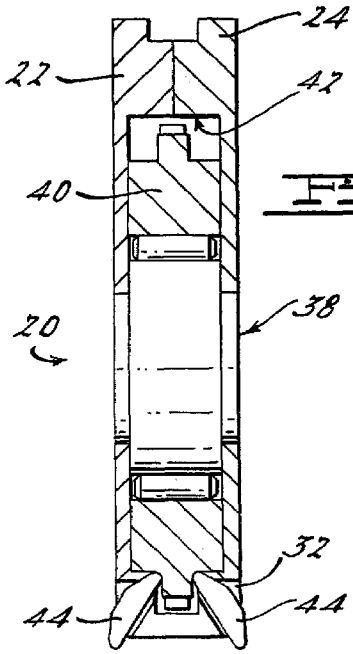
FIG. 4.
FIG. 5.
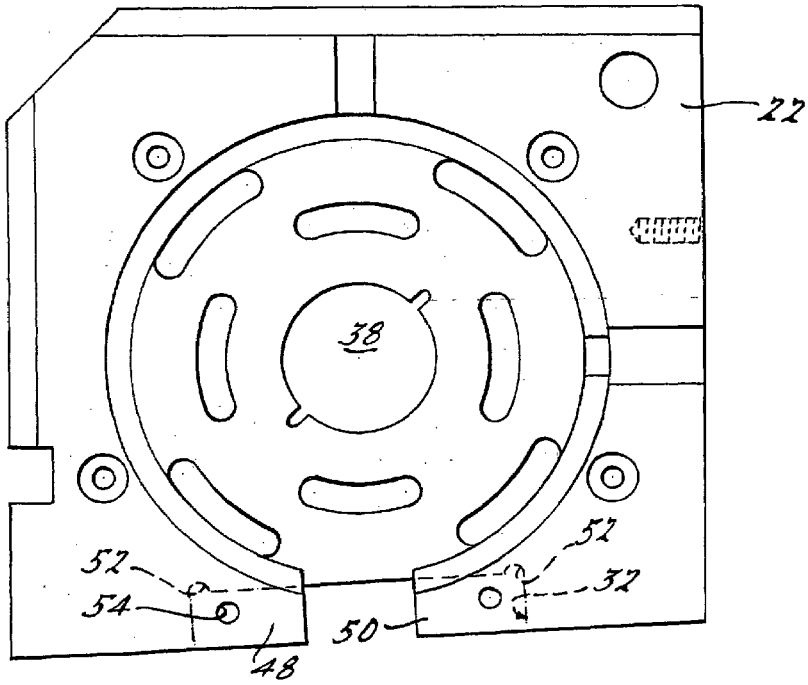

TWO-PIECE UPPER TOOL

This Application claims the Benefit of the Filing Date of U.S. Provisional Patent Application Ser. No. 60/463,960, Filed Apr. 18, 2003 and U.S. Provisional Patent Application Ser. No. 60/466,591, Filed Apr. 30, 2003 and Incorporated By Reference Herein in its Entirety

TECHNICAL FIELD

The invention will broadly relate to deep rolling of fillets of engine crankshafts or other annular areas in metallic work pieces subject to high stress loads. More specifically, the invention will relate to a two-piece split upper tool for deep rolling fillets of engine crankshafts.

BACKGROUND OF THE INVENTION

The state of the art is indicated by the following set of references. Gottschalk U.S. Pat. No. 5,495,738; Gottschalk, et al U.S. Pat. No. 5,445,003; Bone U.S. Pat. No. 5,493,761; Winkens U.S. Pat. No. 5,138,859; Betsrein U.S. Pat. No. 4,561,276; Ostertag U.S. Pat. No. 4,947,668.

It is well known in the art to have various machines and methods to strengthen and finish metal work pieces such as camshafts and crank shafts, for internal combustion engines. In many modern day automobiles engines have been downsized for installation into smaller vehicles. Accordingly, automotive vehicles and their components are being downsized to reduce weight and improve fuel efficiency, hence, smaller engines and crank shafts are needed. Therefore, there is a need to improve the fatigue strength and durability of the smaller, downsized crank shafts. This improved fatigue strength and durability is accomplished by deep rolling of fillets and other circular joint areas upon the crankshaft. The fatigue strength and durability of crank pins and main bearing journals can be significantly increased by deep rolling compressive stresses into the middle of the annular fillets between the pin journals and adjacent counter weights or balancing webs.

During the deep rolling process, the industry has known for numerous years to provide a full flooding process necessary to lubricate and/or cool the work tools and work piece while the work tools are engaging the work piece. A more recent process of lubricating and/or cooling includes a limited coolant supply in the form of a mist. Both of these cooling/lubricating methods tend to cause shavings from the work piece and other debris or foreign matter in the work area to adhere to the work piece and work tool mechanism.

The adherence of debris to the work tool and work pieces creates many problems for the industry. First, there is considerable wear and tear of the tool mechanism, effectively shortening tool life. Second, to increase the life and performance of the work tools, many man-hours are required to disassemble the work tools for cleaning and to reassemble for subsequent use of the cleaned tools. This greatly affects productivity, which is diminished because the work tools cannot be used in the deep rolling process during cleaning. Furthermore, the complexity of disassembling the work tool for cleaning and replacing any worn parts is time consuming and also affects the productivity and life expectancy of the tools. Third, debris collecting on the work area may work its way between the work tool and work piece during the deep rolling process and cause compressive stresses to be misaligned, effectively negating the purpose of the deep rolling process and negatively affecting the life of the crank shaft or other work piece being rolled. Fourth, there is the increased cost of the deep rolling process by having to replace the work rolls more often due to the negative effect of all the shavings and pieces.

There also have been problems with prior art deep rolling machines with regard to the complexity of assembling and disassembling the upper and lower tools to accommodate changes of worn out parts or cleaning of the tools themselves. The amount of time necessary to assemble and disassemble the tools, along with the down time of the line on which the tool is operating all adversely affect the productivity of the tool and the assembly line process. Furthermore, in many prior art deep rolling machines, disassembling of the tool is necessary to replace worn out roller cages, held in place by cage retainers. The roller cages in the prior art machines are set into a predetermined location with relation to the back up roller and work rolls. Once they are worn out they become ineffective and have to be replaced. This entire process is costly in the amount of time necessary to replace, as well as the cost of the parts. Therefore, there is a need in the art for adjustable roller cages that work in conjunction with cage retainers or even without the cage retainers. There also is a need in the art for adjustable split cages for use in conjunction with cage retainers or on their own within a tool structure. Also there is a need in the art for an easier to disassemble and assemble upper and lower tool, decreasing down time and maintenance, and thus increasing productivity of the deep rolling mechanism in the manufacturing environment.

BRIEF DESCRIPTION OF THE DRAWINGS

FIG. 4 shows the cross section of the two-piece upper tool of FIG. 1;

FIG. 5 shows a side view of one portion of a tool similar to the tool shown in FIG. 1;

SUMMARY OF THE PRESENT INVENTION

One object of the present invention is to provide a novel design for a two-piece upper or lower tool for a deep rolling mechanism.

Another object of the present invention is to provide a novel design for a two-piece upper tool that is capable of locking via ball detents or other locking mechanisms such as a ramp and stop.

Other objects, features and advantages of the present invention will become apparent from the subsequent description, taken in conjunction with the accompanying drawings and appended claims.

Figure 6:
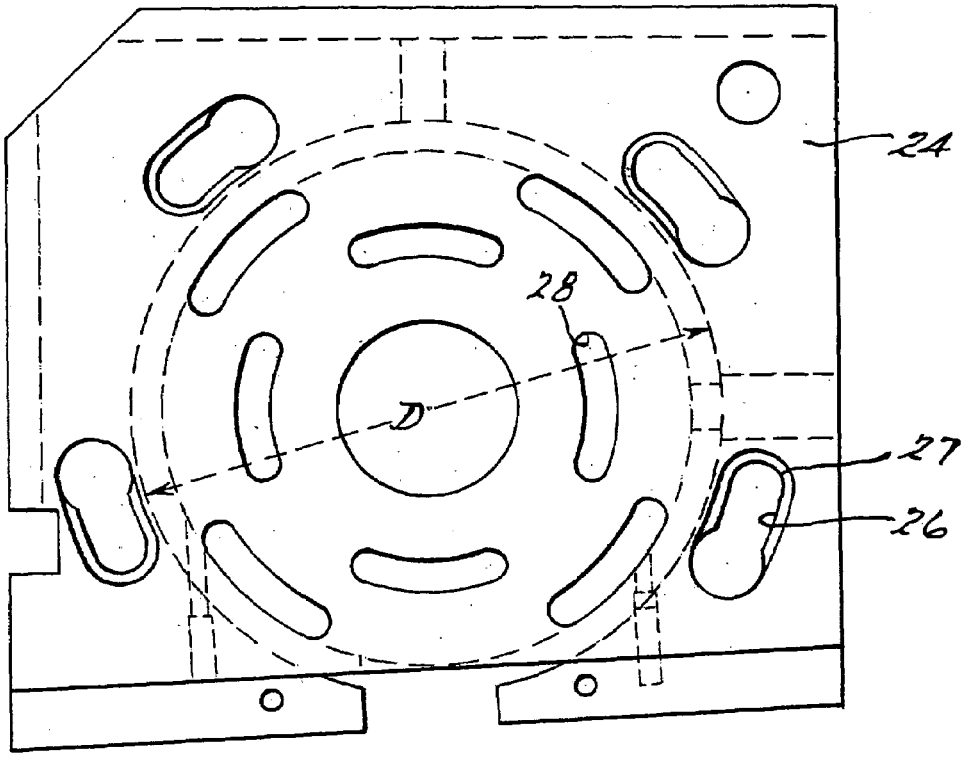
FIG. 6 shows a side view of one portion of a tool similar to the tool shown in FIG. 1.
Figure 7:
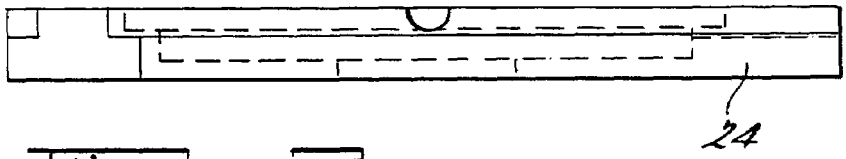
FIG. 7 shows a first edge view of the tool portion of FIG. 6.
Figure 8:
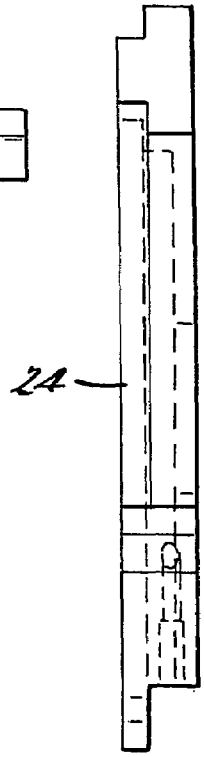
FIG. 8 shown a second edge view of the tool portion of FIG. 6.

According to the present invention the foregoing and other objects and advantages are obtained by a novel design for a two-piece upper work tool and split cages for a deep rolling tool mechanism. The two-piece upper work tool 20 includes a first body member 22 and a second body member 24 which are generally mirror images of each other. The body members 22, 24 include a plurality of orifices 28 therethrough. One of the body members 24 includes a plurality of elongated slots 26 with a circular shape at one end thereof. The other body member 22 has a plurality of fasteners, posts or dowels 30 extending from a surface thereof which interact and mate with the elongated slots 26 on the opposite body member 24. The body members 22, 24 include a rectangular shaped recess 32 on one end thereof and also include a plurality of pockets or cavities on inner surfaces thereof. One of the pockets includes a diameter D, as shown in FIG. 6 for a back-up roller generally encompassing 360° except for a very small top portion thereof. In prior art upper tool mechanisms the backup roller orifice or pocket was well less than 360°, thus the new present design for the upper tool 20 will allow for better support for backup rollers and longer life and increased productivity for the upper tool system. A plurality of split cages 36 are aligned and connected in the rectangular recess 32 of each body member 22, 24. These cages 36 will support the work rollers during the deep rolling of work pieces such as crankshafts and the like.

DESCRIPTION OF THE PREFERRED EMBODIMENT AND BEST MODE FOR CARRYING OUT THE INVENTION

Many designs are known for a lower or upper work tool for use in a deep rolling machine. The present invention can be used for any known lower tool design or upper tool design. Generally, a lower work tool includes a main body essentially forming a rectangular shape with or without a V cut-out on one side thereof. It should also be noted that a generally L-shaped main body for the lower tool might also be used in another contemplated embodiment of the present invention. The main body includes a first and second member with each side symmetrically aligned relative to the other and each including a pair of spaced ridges with each edge forming an annular race. Two hubs are axially positioned between the sides and supported by oppositely aligned races with the hub secured to the ridges by flat head screws or any other known fastener. A pair of receiving rollers are rotatively supported by needle bearings with the needle bearings supported by the hubs.

Figure 1:
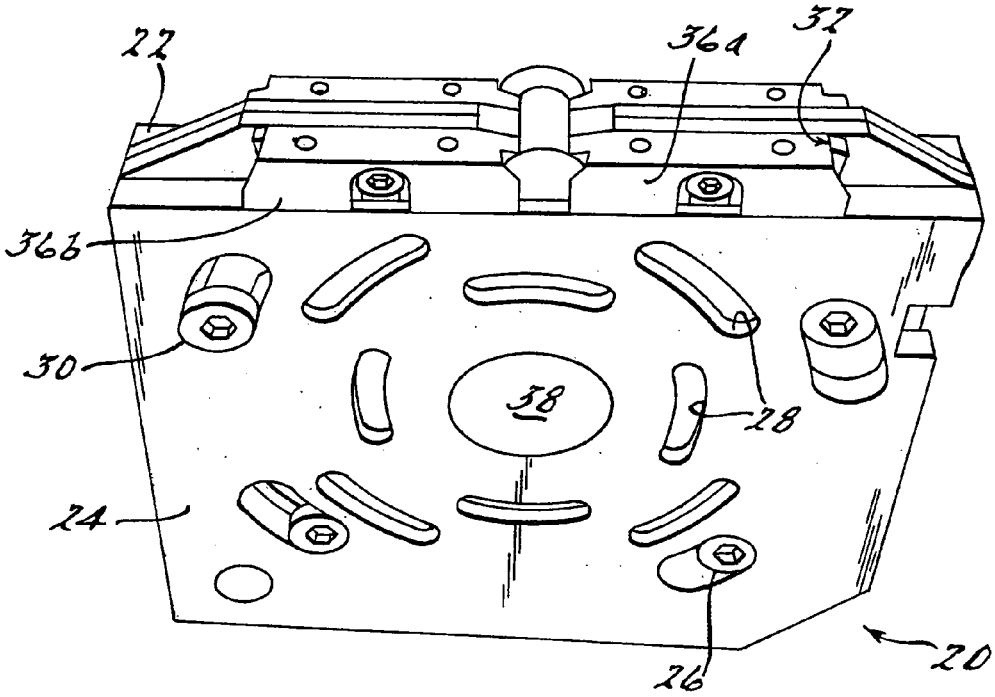
FIG. 1 shows a perspective view of a two-piece split upper tool having a split cage according to the present invention.
Figure 2:
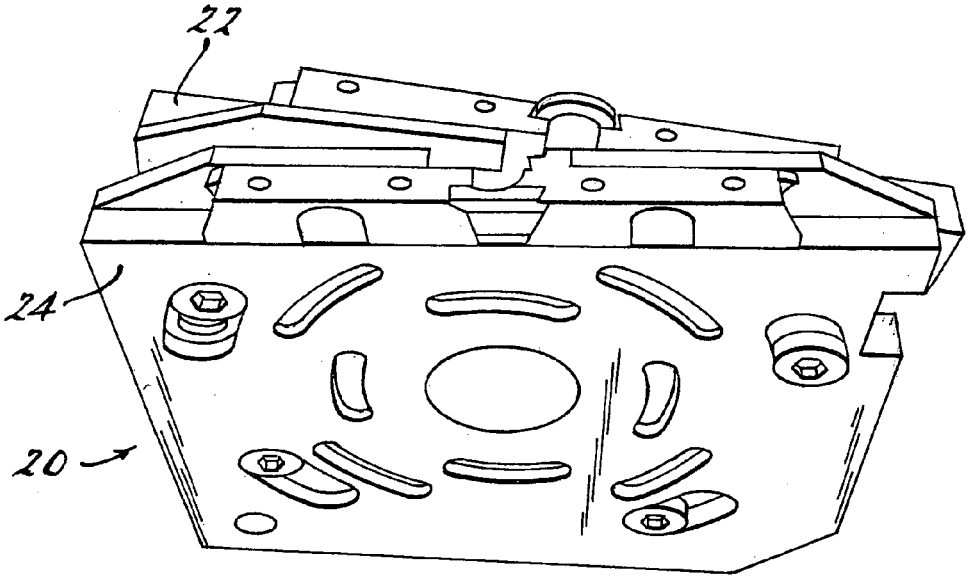
FIG. 2 shows a perspective view a tool similar to FIG. 1 wherein the tool pieces are rotated relative to one another.
Figure 3:
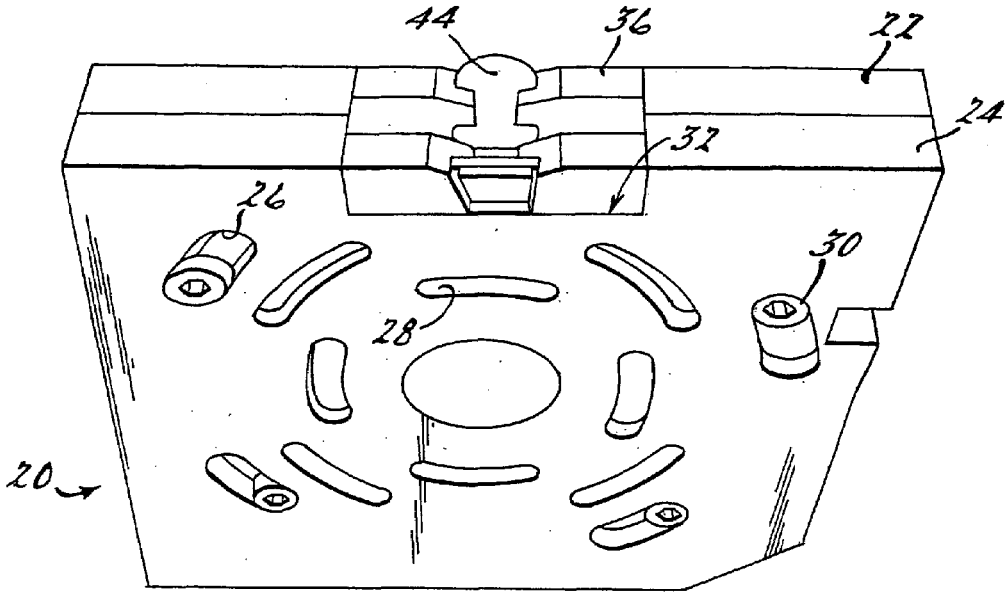
FIG. 3 shows an alternate embodiment of the two-piece upper tool according to the present invention.

Referring to FIGS. 1 and 2, there are shown perspective views of a tool 20, for example, an upper tool for use with a deep rolling apparatus as described herein. The upper tool 20 generally includes a two-piece body or housing having a unique twisting feature, whereby the housing pieces can be alternately locked together or separated for easy disassembly and/or servicing. The two-piece housing includes a first 22 and second 24 housing member which may be generally mirror images of each other, however, it should be noted that the two members may be completely different from each other depending upon design requirements. The two-piece housing 22, 24 generally has a square-like or rectangular-like shape. However, it should be noted that any other shape can be used depending on the needs of the deep rolling machine.

The first and second members 22, 24 of the two-piece housing each preferably include a first plurality of slots 28 through a side surface thereof. One of the housing members, for example, second housing member 24 as shown in FIGS. 1 and 2 includes a second plurality of slots 26. The sets of slots 26 and 28 are preferably spaced substantially equidistant in radial patterns. Slots 28 are used to offer easy cleaning, cooling and lubricating of the work tool during operation. Slots 26 are used in attaching and locking the tool housing members together, as described herein. It should be noted that any other number of sets of slots or even none may also be used depending on the lubrication requirements and the design environment of the deep rolling upper tool 20.

A shaft 38 is arranged within the two-piece housing 20 and is located within orifices of the first and second members 22, 24. Referring also to FIG. 4, there is illustrated a sectioned side view of the two piece housing 20 of FIGS. 1 and 2. A back-up roller 40 is arranged around the outer circumference of the shaft 38. The shaft 38 is fixed within the two-piece housing 22, 24 by a key and slot system such as that illustrated in FIG. 5, or any other known means for fixing a shaft. The two-piece housing 20 preferably includes pockets 42 formed in each member which rotatably hold the back-up roller 40 in position while it rotates around the stationary shaft 38. In a preferred embodiment, pockets 42 are substantially cylindrical, and define substantially, but slightly less than 360° of, a circle. The back-up roller 40 is preferably supported by a plurality of bearings or the like 41 positioned around the outer circumference of the shaft 38.

In a preferred embodiment, one of the housing members, for example second housing member 24, includes a plurality of elongated slots 26 located radially outward from the slots 28 used for cleaning and lubrication, as described above. A plurality of elongated slots, for example four slots, are preferably arranged equidistant from one another, and at a predetermined radial distance from the center of the housing member 24. Each of the elongated slots 26 preferably includes a substantially circular bore 46 at one end thereof. This will allow for the insertion of a fastener such as a screw, post or other fixed pole-like member having a large diameter head in relation to the body portion thereof. During assembly or disassembly of tool 20, the housing members 22 and 24 are engaged together by fitting a plurality of fasteners or pole-like members on a first of the housing members into slots on the other of the housing members. Once the fasteners/poles are inserted into the slots, the housing members are rotated relative to one another to lock them together.

Figure 11:
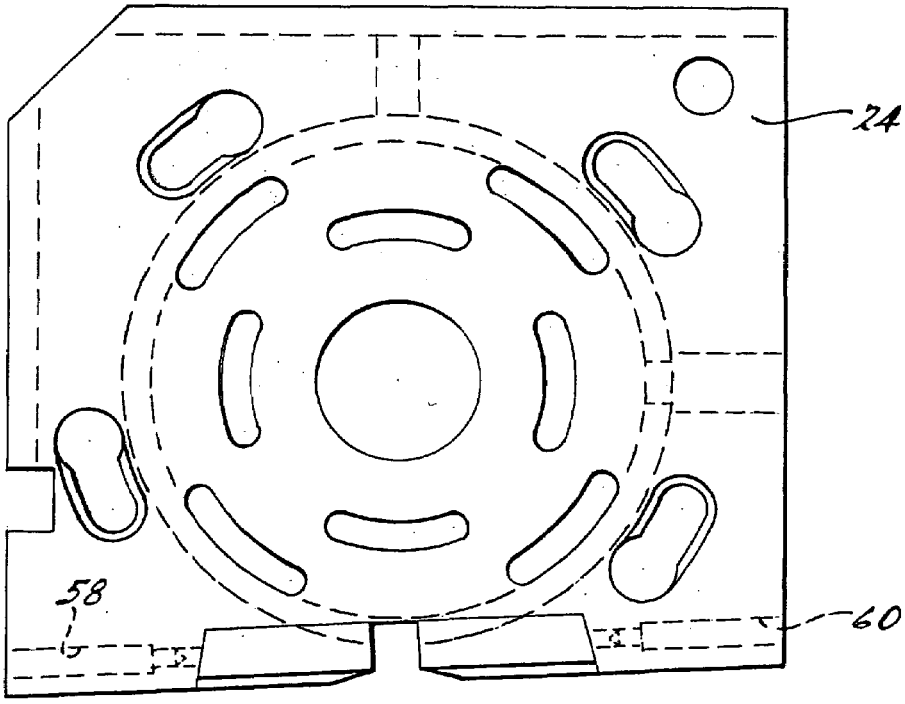
FIG. 11 shows a side view of one portion of a tool according to an alternative embodiment present invention.
Figure 9:
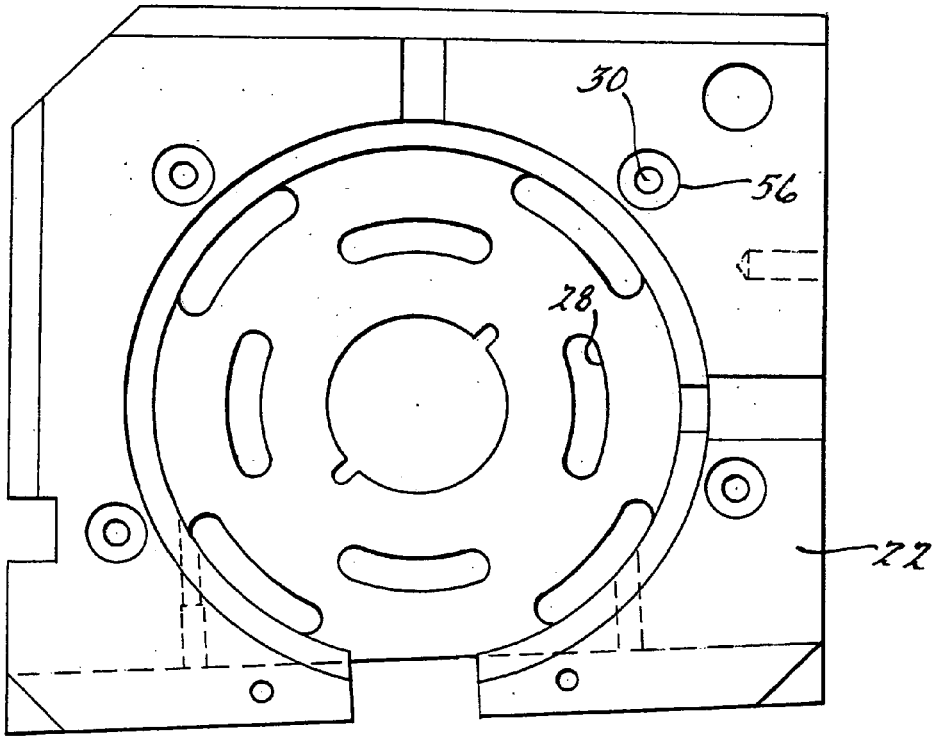
FIG. 9 shows a side view of a tool portion of a two-piece tool similar to the tool of FIG. 1.
Figure 10:
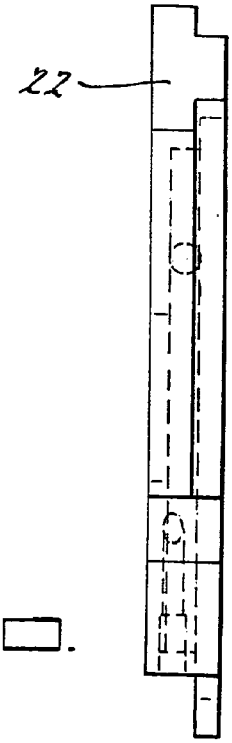
FIG. 10 shows an edge view of the tool portion of FIG. 9.

FIG. 9 illustrates one design for the opposite housing member 22. The upper tool 20 generally has a rectangular or square shape, and includes the plurality of slots 28 for cleaning, lubrication and cooling as described above. The housing member 22 also includes a plurality of orifices 56 through an exterior surface at a predetermined radius and equidistantly spaced so that they align with the elongated slots 26 on the opposite housing member 24. The orifices 56 generally are threaded and capable of receiving a threaded member 30 such as a fastener like a screw or set screw having a pin with a relatively larger head on an opposite end thereof, or another type of dowel, pin, etc. In operation, there are preferably four orifices 56 that align with the four elongated slots 26 on the opposite body housing member 24. A plurality of fasteners 30 or pole-type members, for example such as the member 62 shown in FIG. 11, are secured within the four orifices 56 on housing member 22 and then opposite housing member 24 is aligned on top of housing member 22 such that the fasteners 30 secured in the four orifices 56 are placed through the circular portion 46 of the elongated slots 26. Housing member 22 is then turned in a preferably clockwise direction with relation to housing member 24 until the fasteners come into contact with the ends of the elongated slot 26 opposite the circular ends 46. This will lock the two separate housing pieces 22, 24 of the upper tool to one another in a square position and allow for easy assembly and disassembly of the upper tool 20 by a rotation of the housing members 22, 24 with relation to each other in either a counterclockwise direction for disassembly or clockwise direction for assembly.

It has been contemplated to have a rotation of approximately 13° to positively lock or unlock the housing members 22, 24 with relation to one another. However, any other degree of rotation known is also capable of being used. It should be noted that it has also been contemplated to include at least one other orifice in housing member 24 to hold or receive a ball detent. The ball detent would be located, for example, within housing member 24 and when housing member 22 is placed thereon, over the four poles or fasteners 30 and rotated in a clockwise direction, the ball detent will engage with an inside surface of housing member 22 in such a manner that the ball located at the top of the ball detent will be compressed against the inside surface of housing member 22 and the spring force of the ball detent member will securely hold the members 22, 24 in their completely aligned/square closed position via the spring force of the ball detent. It should also be noted that it is contemplated to use a ramp and stop mechanism between the post 30 and the elongated slots 26 of housing member 22. In such a contemplated embodiment the elongated slots 26 will include a predetermined angular ramp 27 on an inside surface of the first housing member 22. Hence, when the fastener 30 is placed through the large opening 46 of the elongated orifice 26 it will slide up the ramp that has an increasing inclined surface until the fastener 30 encounters the opposite end of the elongated slot 26 and is placed into contact with a shoulder stop member or the like at that end on an inside surface thereof.

The back-up roller 40 will generally rotate at a speed proportional to rotation of the work rolls 44 of the upper tool assembly. There are preferably a plurality of work rolls 44 located at predetermined positions of the two-piece housing 22, 24. A first and second work roll 44 may be arranged within a recess 32, which is cast or machined within the two-piece housing 22, 24. It is also contemplated to have only one work roll 44 located at each position. FIG. 5 shows housing member 22, illustrating the preferably rectangular recess 32 or cutout on one edge thereof. In the embodiment of FIG. 5, the rectangular cutout 32 preferably includes a first and second tab 48, 50 extending from each end thereof. In one preferred embodiment, the cutout 32 also preferably includes a rounded arcuate portion 52 near each end thereof that is fashioned to receive a complementary portion of a work roll cage 36 therein. A circular orifice 54 or other shaped orifice is preferably placed through each tab 48, 50 on each end of the rectangular recess 32. In a preferred embodiment, a fastener can be secured in orifices 54 to retain a cage positioned in recess 32. The work rolls 44 will rotate along the surface of a crankshaft lobe or the like and also will rotate the back-up roll 40 in a reciprocal manner. It should be noted that the upper tool 20 according to the present invention is preferably made of a steel material, but that any other material such as bronze, composites, plastics, ceramics, or the like may also be used for forming the two pieces for the upper tool, as described herein.

In another aspect, the present invention provides a unique split cage design, wherein two cage portions 36*a* and 36*b* are positioned about and retain each work roll. Various means may be used to retain the cages with the housing members 22 and 24. For example, as described above, fasteners can be used to secure the cage portions 36*a* and 36*b* against tabs 48, 50. An alternative design for holding the split cage portions 36*a* and 36*b* is illustrated in FIG. 12, includes first and second orifices 58 and 60 through a bottom area of the upper tool. The orifices extend from opposite sides of the tool member 24 into the recess 32 formed at the bottom portion thereof. The orifice 58, 60 is generally threaded through a portion thereof. A fastener or screw 62 with a pin or dowel integrated on an end is then arranged in the orifice 58, 60 and is used to adjust and securely hold a cage portion 36*a*, 36*b* in the recess 32 of the upper tool 20. The threaded dowel or pin 62 will allow for adjustment of the cage portions with respect to the work rolls 44 for the upper work tool 20. The orifices 58, 60 may be located on both halves of the housing 22, 24 thus a total of four orifices which include the pins and dowels are used for each upper work tool 20.

It should also be noted that any combination of the split cages described herein can be used with any existing prior art upper tool or with the present two-piece design upper tool 20. The use of the split cages will allow for removal of one work roll at a time and for micro-adjustments of the split cages with relation to the work roll to provide for better productivity and efficiency of the two-piece upper tool rolling mechanism.

It should be noted that the two-piece rotatable upper tool 20 increases ease of assembly and disassembly in manufacturing of the upper tool unit itself. It also increases productivity by lessening any cleaning time or down time due to work roll failure and wearing because of the ability to change one work roll at a time and to micro adjust the precision of the cages holding the work roll in a proper position with relation to the crank shaft being rolled by the novel split cage 36.

Still further embodiments function as described above with minor design and operational difference. It is even contemplated to have a "mini twist" design for the two-piece upper tool that will have a twist assembly feature as described above but in the form of a smaller package cartridge that is held in a holder member. All of the twist technology may also be used in any known lower tool.

While it may be apparent that the preferred embodiments of the invention disclosed are well calculated to fill benefits, objects or advantages of the invention, it will be appreciated that the invention is susceptible to modifications, variations and change without departing from the proper scope or fair and necessary use of the subjoined drawings and appended claims.

What is claimed is:

1. A deep rolling tool comprising:

a housing having first and second members;

a shaft fixed relative to said housing and extending between said first and said second members;

a roller rotatable about said shaft and supported thereon;

at least one work roll rotatably supported by said roller;

said first and said second members rotate relative to one another between a first position at which said members are substantially aligned and locked, and a second position at which said members are separable.

2. The deep rolling tool of claim 1 comprising a detent member mounted in one of said members and extendable into the other of said members to lock said members together at said first position.

3. The deep rolling tool of claim 1 comprising:

a plurality of elongate members extending from one of said housing members; and a plurality of slots in the other of said housing members, each of said slots corresponding to and receiving one of said elongate members;

whereupon twisting said first and said second housing members between said first and said second positions will allow each elongate member to traverse the corresponding slot, said elongate members locking said housing members together at said first position.

4. The deep rolling tool of claim 3 wherein each of said elongate members comprises an enlarged head; and each of said slots includes a substantially circular end portion larger than and corresponding to the enlarged head of the corresponding elongate member.

5. The deep rolling tool of claim 3 wherein each of said elongate members is threadedly received in said one of said housing members.

6. The deep rolling tool of claim 3 wherein a relative radial displacement between said first and said second housing members at said second position is approximately 13°.

7. The deep rolling tool of claim 4 comprising ramping surfaces formed along edges of each of said slots and defining an inclining surface along a length thereof, said enlarged heads engaging said ramping surfaces.

8. The deep rolling tool of claim 1 comprising a substantially rectangular recess extending along an edge of at least one of said first and second housing members; and first and second substantially mirror image cage portions mounted in said recess, said cage portions retaining said at least one work roll.

9. The deep rolling tool of claim 8 wherein said first and second cage portions are adjustable in said recess.

10. An apparatus for deep rolling a workpiece comprising:

an upper tool having at least one rolling member engageable against the workpiece;

a lower tool having at least one rolling member engageable against the workpiece;

at least one of said upper and lower tools includes first and second housing members twistable relative to one another between a first radial position at which said members are locked together and a second radial position at which said members are separable.

11. The apparatus of claim 10 wherein:

at least one of said first and second housing members includes a plurality of elongate members; and the other of said housing members includes a plurality of slots corresponding to and receiving said elongate members.

12. The apparatus of claim 10 wherein said upper tool includes first and second housing members.

13. The apparatus of claim 10 wherein said lower tool includes first and second housing members.

14. The apparatus of claim 10 wherein at least one of said first and second housing members defines a recess having a cage member positioned therein, said recess communicating with a bore having a fastener positioned therein for securing the cage in said recess.

15. The apparatus of claim 10 wherein said first and second housing members each include a flange extending outwardly from and longitudinally along peripheral edges thereof, said flanges substantially aligned at said first position; and first and second cages are secured against said flanges.

16. The apparatus of claim 10 wherein at least one of said first and second housing members comprises a pocket for receipt of said back up roller, said pocket extending radially in said housing member substantially 360°.

* * * * *